US006793021B1

(12) United States Patent
Fanguy

(10) Patent No.: US 6,793,021 B1
(45) Date of Patent: Sep. 21, 2004

(54) SCREEN TABLE TONG ASSEMBLY AND METHOD

(76) Inventor: Robert P. Fanguy, 3507 Captain Cade Rd., Broussard, LA (US) 70518

( * ) Notice: Subject to any disclaimer, the term of this patent is extended or adjusted under 35 U.S.C. 154(b) by 0 days.

(21) Appl. No.: 10/357,542

(22) Filed: Feb. 3, 2003

(51) Int. Cl.[7] ..... E21B 19/16
(52) U.S. Cl. ..... 166/380; 166/77.51; 166/78.1
(58) Field of Search ..... 166/379, 380, 166/77.51, 77.52, 77.53, 78.1, 85.1

(56) References Cited

U.S. PATENT DOCUMENTS 6,439,064 B1 8/2002 Fanguy

2003/0047319 A1 * 3/2003 Courts ..... 166/379

* cited by examiner

*Primary Examiner*—William Neuder
(74) *Attorney, Agent, or Firm*—Robert N. Montgomery

(57) ABSTRACT

A screen table and tong assembly whereby a sand screen table structure adaptable to a rotary table is used to capture and suspend sand screen subsections within the well bore is further adapted to include a pair of articulated opposing manual tong assemblies. The tong assemblies are pivotal and transversely positionable relative to the screen table. Provisions are made for adapting a slip set in cooperation with said screen table and tong assembly for capturing and supporting wash pipe within the sand screen subsections. Additional adaptations include a custom spinner tong assembly for rotating the sand screen tubular subsections and wash pipe sections.

20 Claims, 8 Drawing Sheets

SCREEN TABLE TONG ASSEMBLY AND METHOD

FIELD OF THE INVENTION

This invention relates generally to operations involving the handling and deployment of sand control screens used in down hole oil and gas well completion packing operations and more particularly to the apparatus used to make up and uncouple the various screen assemblies used in such operations.

GENERAL BACKGROUND

After the open hole in a well has been cleaned, what is known in the art as a gravel-packing screen and/or gravel-packing tool assemblies are run into the well bore. The tool assembly is usually run with one or more subsection screen sections extending from the toe of the well to the well casing with at least one joint located inside the well casing followed by several joints of blank tubing before being connected to a shear-out safety joint and the gravel pack tool itself. A wash pipe is usually run inside the screen for effective circulation of fluids.

The function of the gravel pack tool is to maintain hydrostatic pressure on the open-hole section of the well at all times to prevent bore hole collapse. Maintaining a hydrostatic over-balance throughout all operations and the use of proper fluid characteristics eliminates the need to run alternative flow path devices.

When running the gravel pack tool and the various screen assemblies in or out of the well bore, a screen table or support structure adaptively fixed to the rotary table located at the drill rig floor, is used to catch or capture the sand screen subsections of the tool assembly at each joint connection. The tubing string containing the screens is thus suspended within the well bore without damaging the screens or the gravel packer itself. The screen table is used to support the string in place of pipe slips because of the limited space at the joint between the screen subsections and to prevent damage to the screens. However, in some cases, slips are used in conjunction with the screen table to capture and suspend the wash pipe being inserted or withdrawn from within the screen string assembly.

Presently the screen and wash pipe connections are made up with conventional pipe wrenches or manual pipe tongs. However, recent requirements make it necessary to apply specified torques to these joints, thereby presenting a problem. Conventional power tongs having torque setting capability are simply too large due to space limitations and too expensive to downsize in most cases due to limited applications requirements.

Until recently hand tongs or pipe wrenches had no torque setting capability. Generally only the larger tongs and pipe spinner system have torque control and presetting capability. However, in some cases, torque indication systems have been employed whereby the tong or other such gripping tools are attached to a cable (cat line) that in turn is attached to a load cell. This arrangement requires significant time to set up and use and requires significantly more space than is generally available when working with sand screen replacement. Such systems are inherently inaccurate, dangerous, cumbersome, and lack efficiency.

A more unitized hand tong is available that utilizes a traditional torque setting handle integral with the tong as seen in U.S. Pat. No. 6,439,064. However, even this tool is too slow in some cases and requires a significant amount of labor, generally two men to manipulate the tong and a backup gripping tool in place and then apply the proper torque to each joint.

A more convenient and labor reducing assembly is obviously needed that allows for both a relatively small torque head and backup tong assembly. The tong assembly should remain in place adjacent the centerline of the well bore and be capable of swiftly coupling and uncoupling sand screens where space between the screen elements is minimal. It is equally important that the tong assembly be capable of coupling and uncoupling wash pipe being inserted within the sand screen string, also with preset torque capability. It would be advantageous for such an arrangement to utilize a manual tong assembly with shorter tong handles than are in current use and be confined to within the perimeter of the screen or rotary table and further reduce the manpower required to make up such connections. It is therefore an object of the following disclosure to provide such an apparatus.

SUMMARY OF THE INVENTION

A screen table and tong assembly whereby a sand screen table structure adaptable to a rotary table is used to capture and suspend sand screen subsections within the well bore is further adapted to include a pair of articulated opposing manual tong assemblies. The tong assemblies are pivotal and transversely positionable relative to the screen table. Provision is made for adapting a slip set in cooperation with said screen table and tong assembly for capturing and supporting wash pipe within the sand screen subsections. Additional adaptations include a custom spinner tong assembly for rotating the sand screen tubular subsections and wash pipe sections.

The tongs and their torque arm assemblies are interchangeable with a range of tong heads of different types and sizes including pipe wrenches, chain tongs, and strap wrenches and provide reversibility between left and right hand torque applications.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
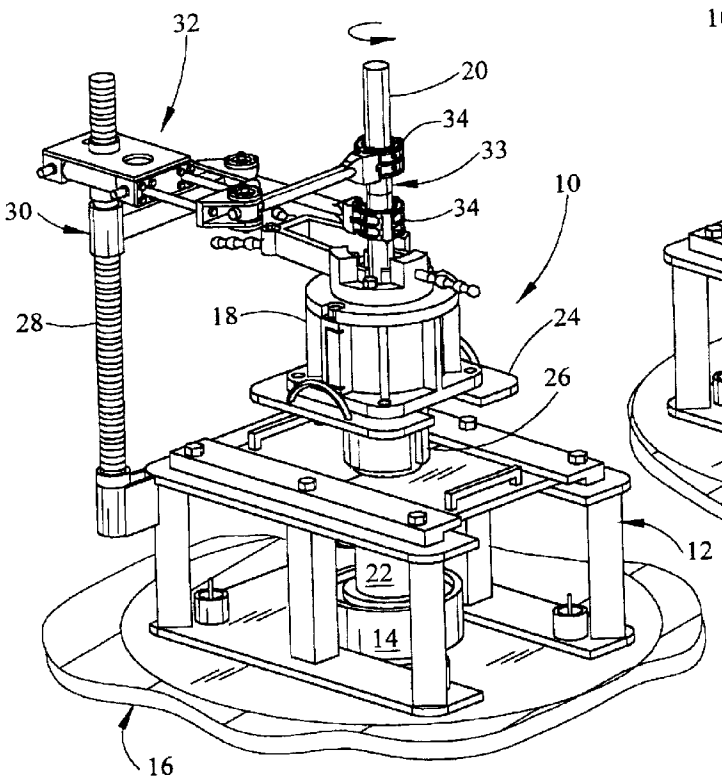
FIG. 1 is a frontal isometric view of the screen table and tong assembly.

Looking first at FIG. 1 it can be seen that the screen table assembly 10 is composed of a screen table 12 attached to the rotary table 14 generally located on the floor 16 of an oil and gas well platform. Slips used for gripping and supporting the tubing string within the well bore when coupling and uncoupling the various sections of pipe, tubing or tool joints that make up the well's tubular string are not used when coupling and uncoupling sand screen subsections during packing operations. However, a set of slips 18 is required when inserting washout tubing 20 within the screen sections 22 being suspended within the well bore by the screen table 12. The slip set 18 is supported by a slotted plate 24, which is in turn supported by a slotted tubing collar 26.

Figure 2:
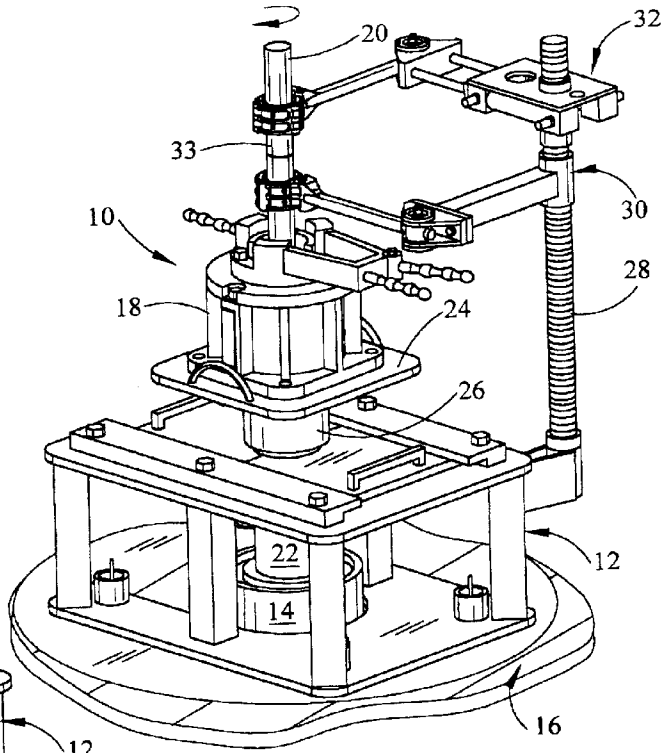
FIG. 2 is a rear isometric view of the screen table and tong assembly.

As seen in FIGS. 1 and 2, the screen table assembly 12 is fitted with a threaded vertical column 28 from which a pair of tong assemblies 30, 32 is pivotally attached, one of the tong assemblies being a backup or retaining tong assembly 30 and the other being a hydraulic or gas actuated torque tong assembly 32. Upon grippingly engaging the wash pipe 20 adjacent the pipe joint 33, the torque tong assembly 32 is actuated, thus rotating the upper pipe and uncoupling the joint 34 as shown in FIG. 1. Conversely, as seen in FIG. 2, retracting the torque arm assembly 32 tightens the joint 33 to a pre-set torque requirement.

Figure 3:
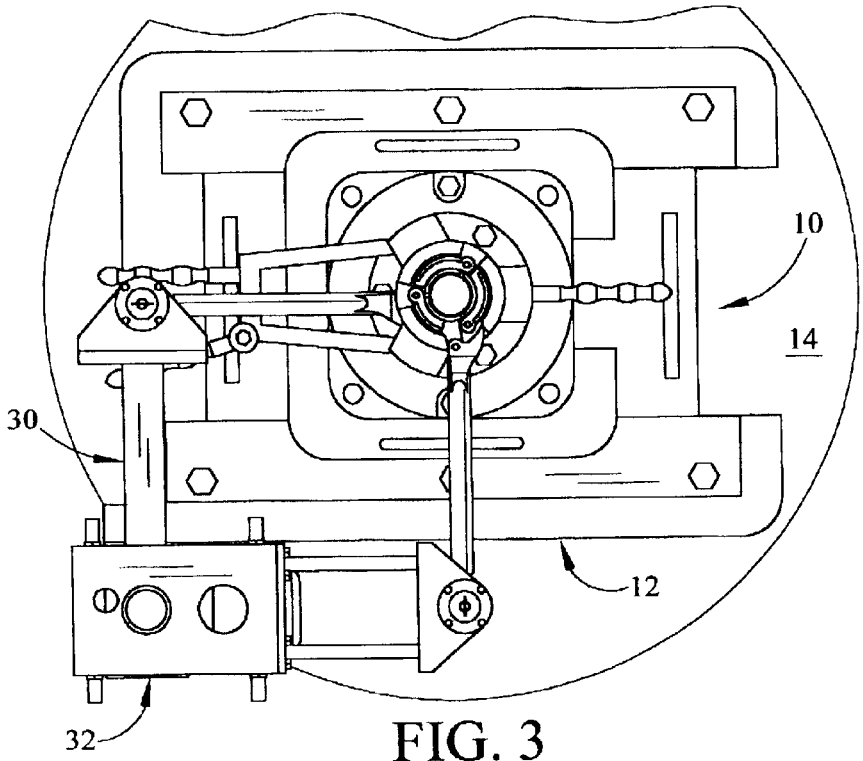
FIG. 3 is a top view of the screen table and tong assembly with torque applicator extended.
Figure 4:
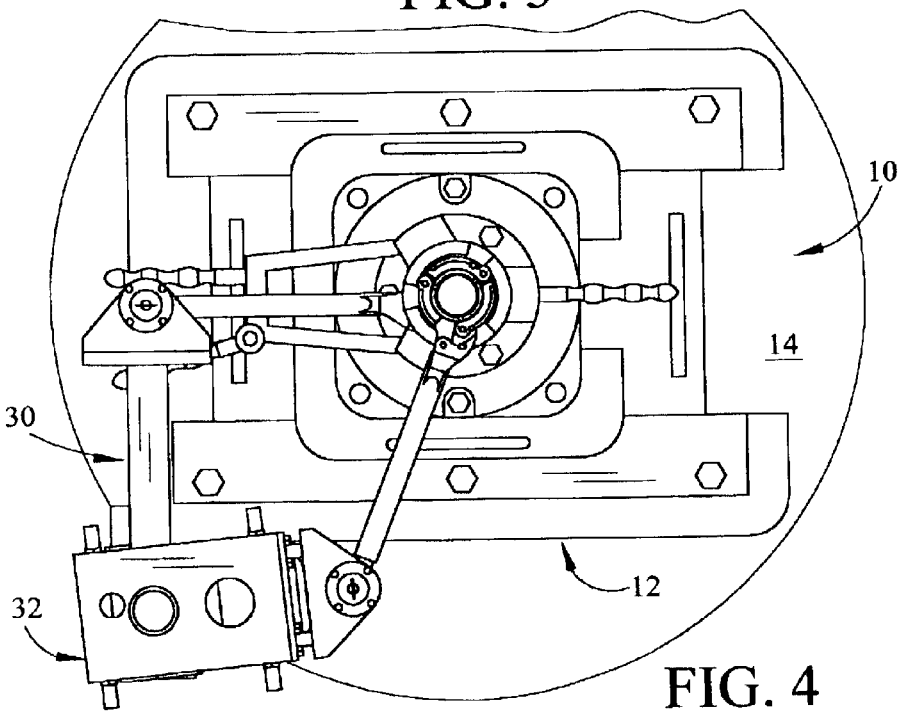
FIG. 4 is a top view of the screen table and tong assembly with torque applicator retracted.

Turning now to FIGS. 3 and 4 we see that the tong assemblies 30, 32 work in close proximity to the screen table assembly 12 thus providing clear movement around the rotary table 14 and requiring no cables or long extension torque arms to be manipulated by rig personnel. Further, as seen In FIG. 3, the back up tong assembly 30 and the torque tong assembly 32 are positioned at 90 degrees to one another. When the torque tong assembly 32 is actuated and the pipe is rotated all pivotal motion is inboard as seen in FIG. 4, thereby reducing risk for personnel. It should also be noted that only one person may manipulate the arm easily.

Figure 5:
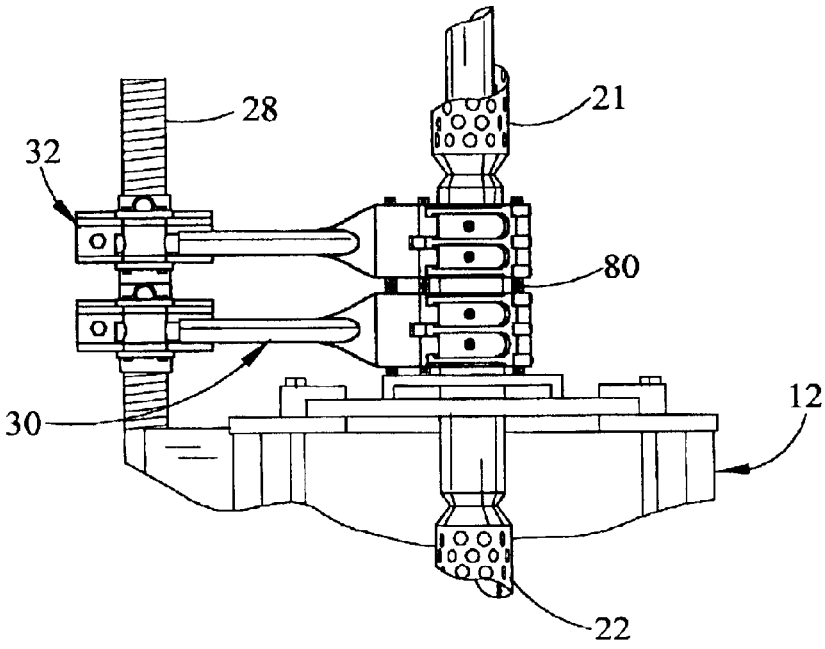
FIG. 5 is a partial elevation view of the screen table with tongs gripping the screen tool joints.
Figure 6:
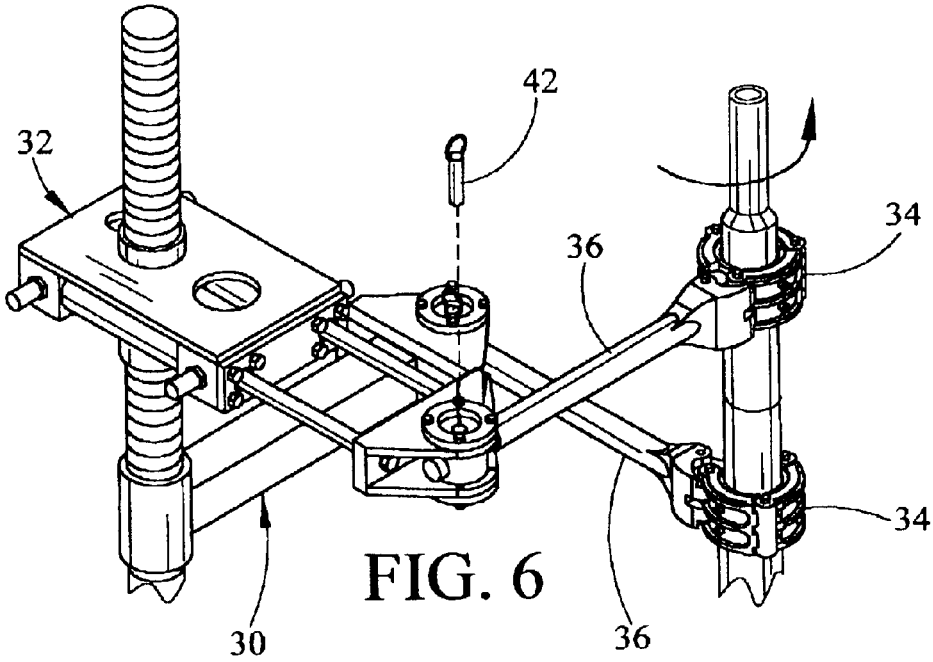
FIG. 6 is a partial isometric view of the torque and retaining tongs seen in FIG. 1.

Looking now at FIG. 5 we see that the tong assemblies 30, 32 may also traverse the threaded vertical column 28 to a point slightly above the screen table assembly 12. In FIG. 6 the tong assembly heads 34 and arms 36 may be replaced with larger ones, as seen in FIG. 5, to accommodate the sand screen collars by removing the pins 42 and the clips 76 in each of the tong assemblies as shown in FIG. 6 and better seen in FIG. 9. The tong heads 34 may be any type of tubular griping apparatus including pipe wrenches, chain wrenches or strap wrenches as well as the tong heads shown.

Figure 7:
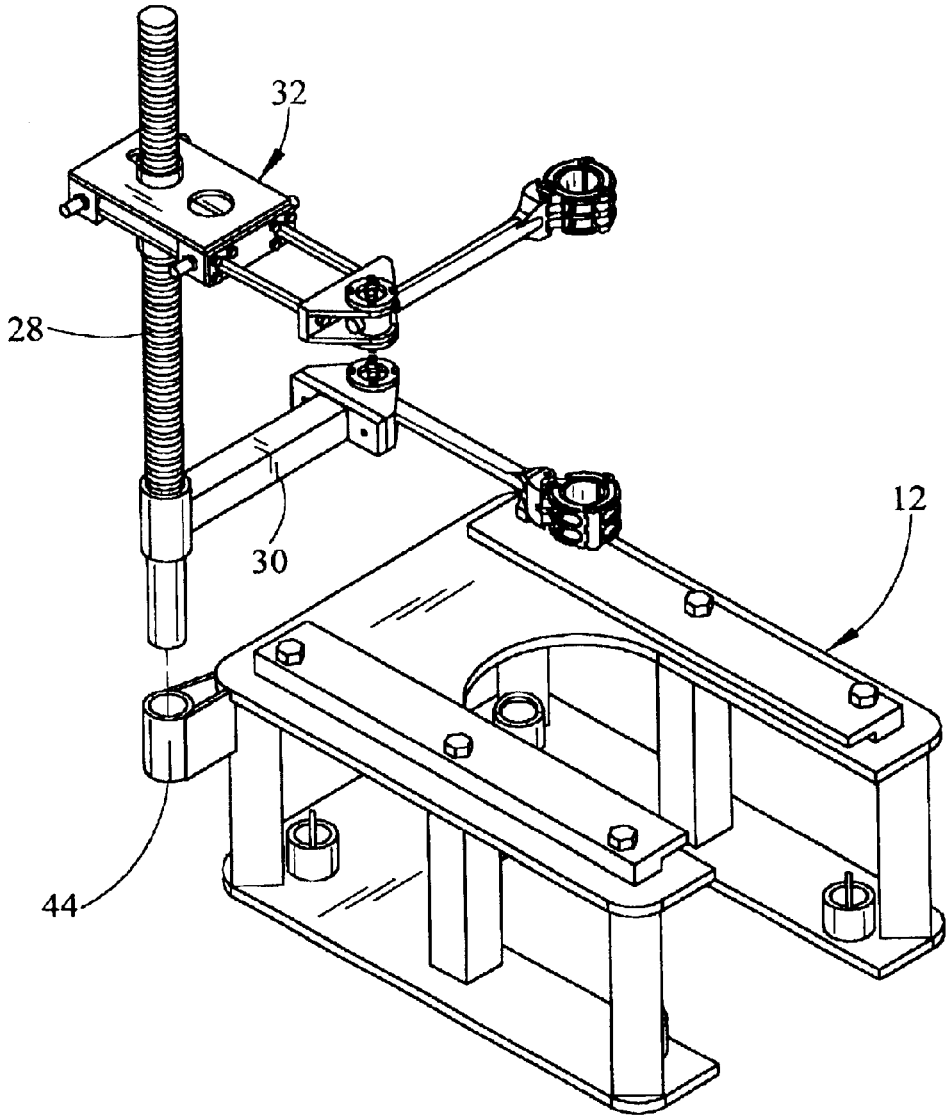
FIG. 7 is an isometric exploded view of the tong and screen table assembly.

As seen in FIG. 7, the tong assemblies 30, 32 and their vertical, threaded, support column 28 may be easily removed from their support sockets 44 for transport. The vertical. threaded column 28 may be secured within the socket 44 at assembly or simply allowed to rotate therein. Rotating the vertical threaded column 28 while holding the tong assemblies 30, 32 traverses the tong assemblies from a high to a lower position or vise-versa.

Figure 8:
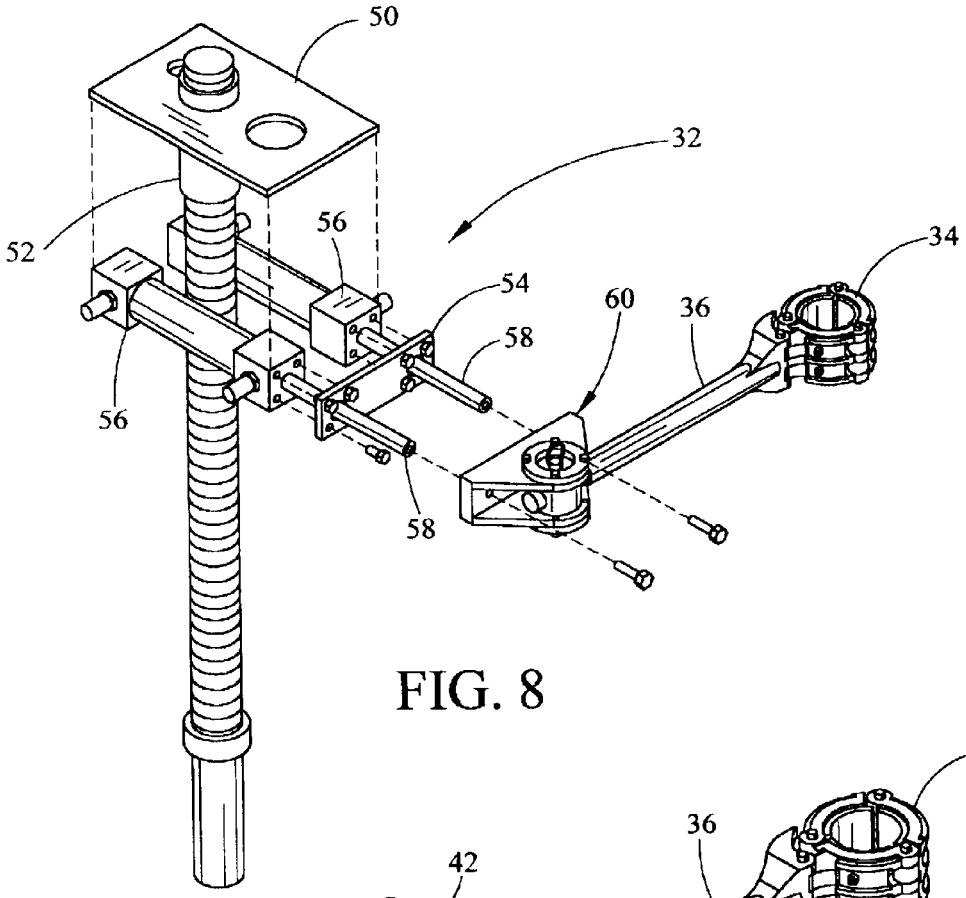
FIG. 8 is an isometric exploded view of the tong torque assembly.

Looking now as FIG. 8 we see that the torque assembly 32 includes a mounting plate 50 attached perpendicularly to a threaded collar 52 and an actuator adaptor plate 54 mounted perpendicularly to the mounting plate 50, and a pair of linear actuators 56 attached to the adaptor plate 54 in a manner whereby the rods 58 of the actuators are attached to a pivot head assembly 60 and are free to extend and retract the pivot head assembly 60 relative to the mounting plate 50.

Figure 9:
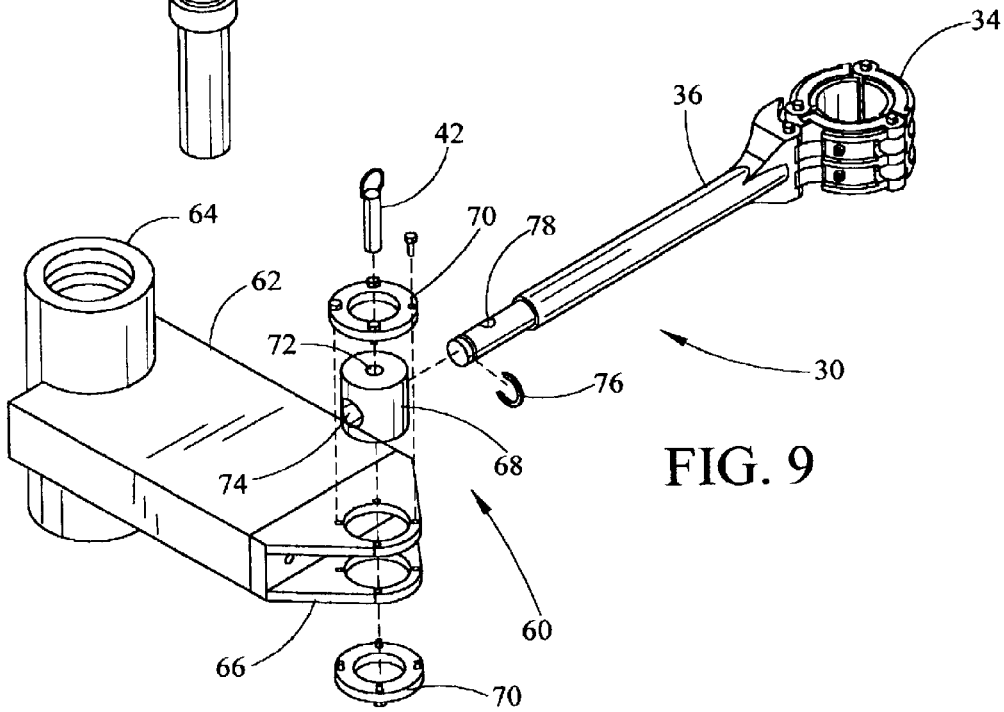
FIG. 9 is an isometric exploded view of the retainer tong assembly.

As seen in FIG. 9 the backup or retainer tong assembly 30 includes a pivot head assembly 60 attached to a box tube arm 62, which is in turn attached to a threaded collar 64. The pivot head 60 further includes a base clevis member 66, a pivotal hub member 68 having a central pin bore 72, and a perpendicular bore 74 is captured within the clevis member by removable flanges 70 attached externally to the base clevis member 66. The tong head 34 and its arm 36 are rotatably connected to the pivotal hub member 68 by inserting the arm portion 36 through the perpendicular bore 74 and securing it with clip 76. It should be noted that the tong head 34 may be reversed for opposite left or right hand rotation gripping by removing the pull pin 42 inserted in a perpendicular bore 78 located in the tong arm 36. It should be noted that the tong arms 36 and heads 34 are interchangeable and easily exchanged by removing the pull pins 42 and the clips 76.

Figure 10:
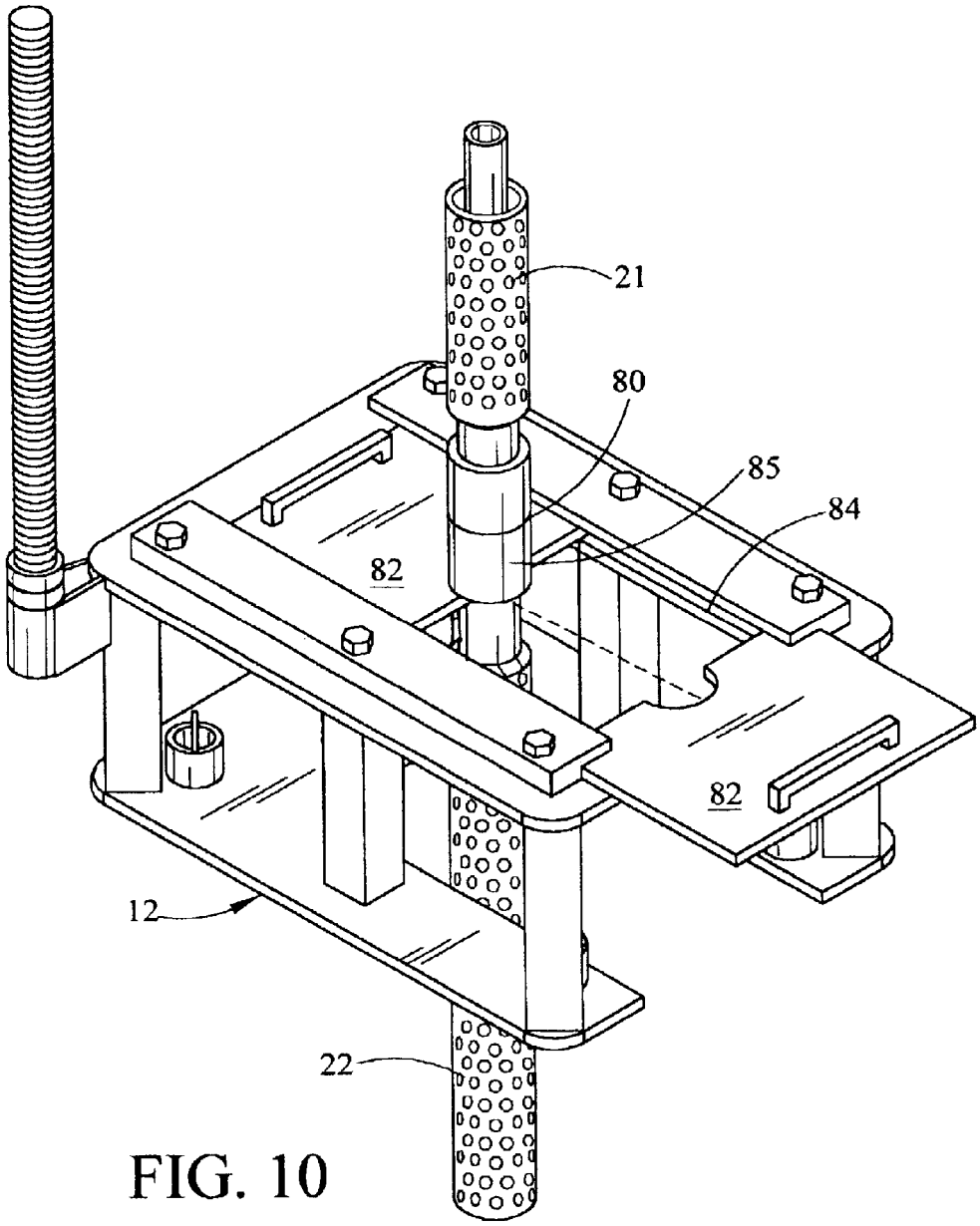
FIG. 10 is an isometric view of the screen table assembly without tongs.

Turning now to FIG. 10, we can see that down hole sand screens are connected as close as possible, leaving little or no room for gripping the tubular joint 80 without damaging the screens 21, 22. Therefore, as previously discussed, slip sets 18 are not applicable. Suspension of the screen string is therefore accomplished by utilizing what is known in the industry and previously referred to herein as a screen table assembly 12, the table being placed directly over the well head and supported by the rotary table and rig floor partially encircles the tubular column extending into the well bore. When the screens 21, 22 are being run in or out of the well bore, capture doors 82 as shown in FIG. 10 are positioned below the box end 85 of the tubular joint 80. This allows the string to be held in suspension while the upper screen section 21 is added or removed from the lower screen section 22. Simply sliding the doors 82 in or out within the channel 84 captures or releases the screen string.

Figure 12:
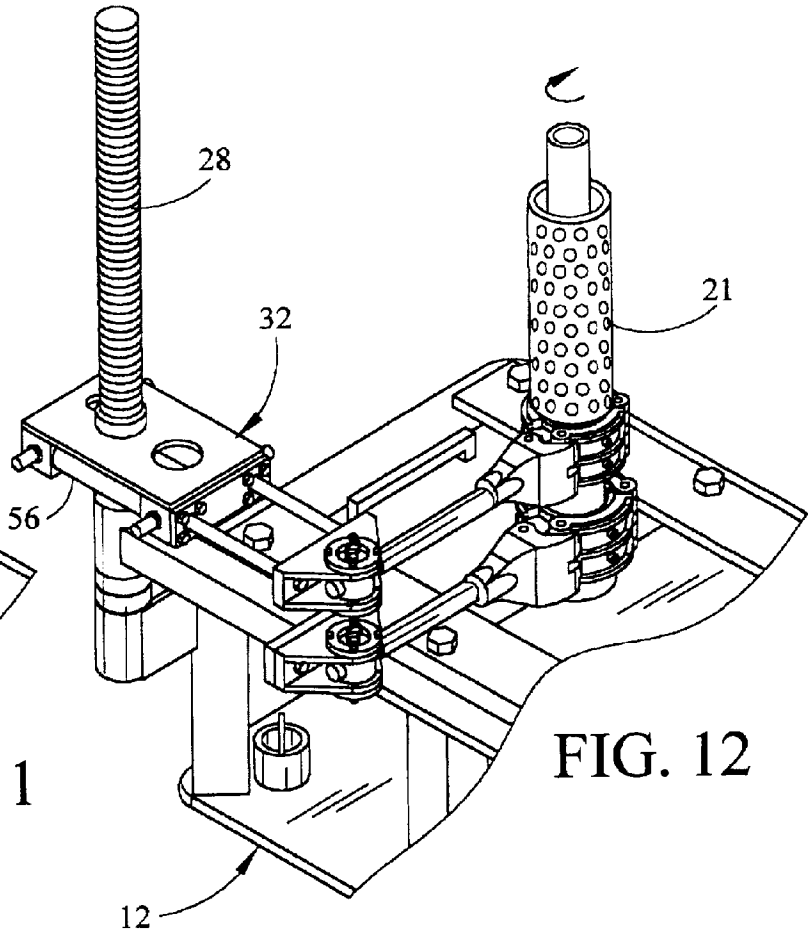
FIG. 12 is an isometric view of the screen table with both torque tong and retaining tong and screen coupling joint.
Figure 11:
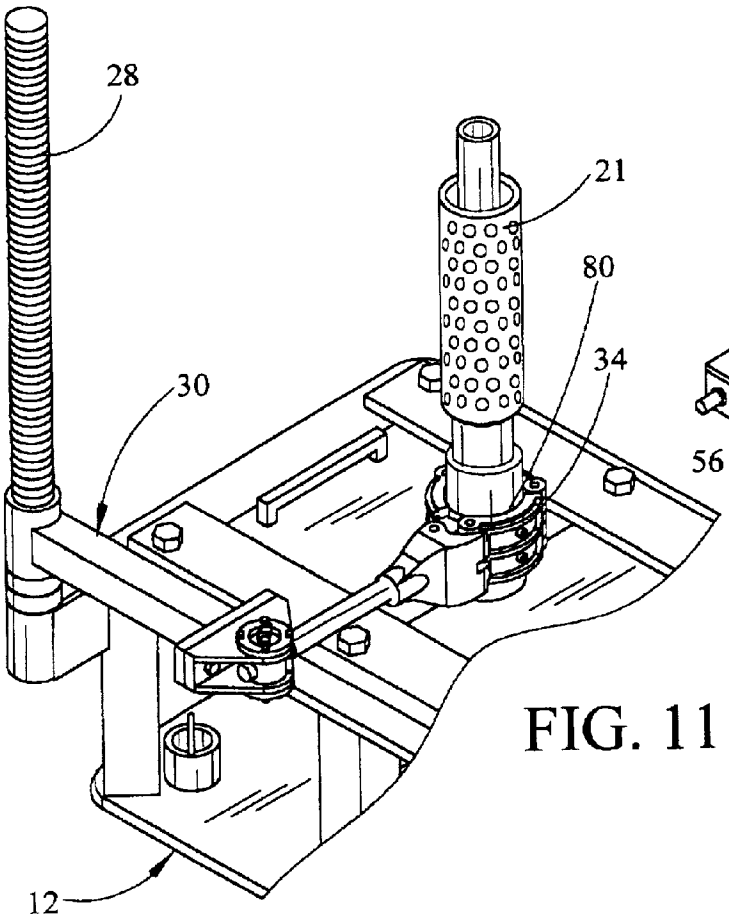
FIG. 11 is an isometric view of the screen table with retaining tong and screen coupling joint.

Once the screen string has been captured by the screen table assembly 12, as illustrated by FIG. 11, the backup or retaining tong assembly 30 is traversed into position along the threaded vertical column 28 to a position laterally adjacent the screen tubular joint 80 being captured and the tong head 34 is positioned around the joint to be coupled or uncoupled. Likewise, the torque arm tong assembly 32 is traversed into position along the vertical threaded column 28, as seen in FIG. 12, to a point above the retainer tong assembly 30 and positioned for engagement with the screen section 21, 22 to be coupled or uncoupled. The actuators 56 are then engaged, thus applying rotative torque to the joint.

Figure 14:
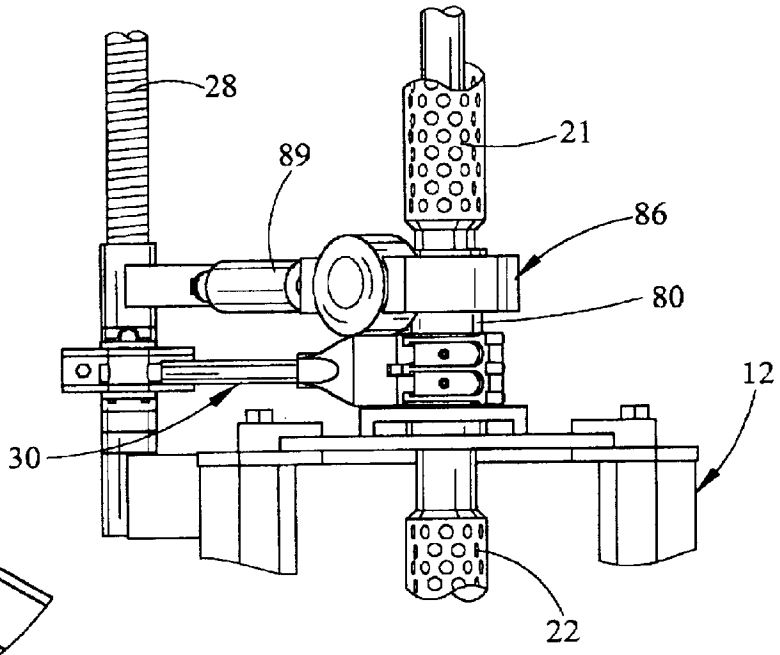
FIG. 14 is a side elevation view of the retaining tong with spinner attachment as shown in FIG. 13.
Figure 13:
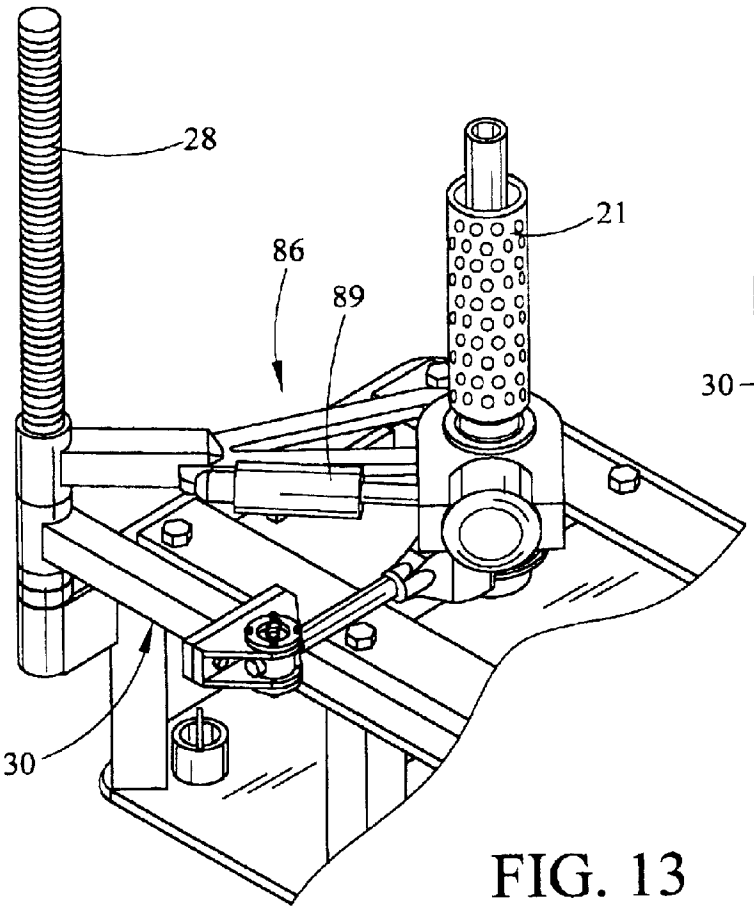
FIG. 13 is a partial isometric view of the screen table, retaining tong with spinner attachment.

In some cases it may be advantageous to spin the tubulars into place prior to applying the required torque. Therefore, a miniature spinner assembly with torque actuator 86 as shown in FIG. 13 may be provided in combination with the backup or retainer tong 30. In this case the spinner assembly grips the upper tubing section of the joint 80, as seen in FIG. 14, while the backup tong assembly 30 grips the lower tubular section. The spinner assembly 86 then rotates the upper section through several turns to engage or disengage the pipe threads comprising the joint 80. When the spinner 86 has reached a predetermined torque, the linear actuator 89 provides the final predetermined torque to the joint 80.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A gravel packer screen table and tong assembly attachable to a rotary table located on a drilling platform generally used for capturing and suspending a string of sand screen tubular sections within a well bore and applying a preset torque to the connection joints of said sand screen tubular sections comprising:

a) a screen table assembly; and b) a tong assembly attached to said screen table.

2. The gravel packer screen table and tong arm assembly according to claim 1 wherein said tong assembly comprises:

a) a vertical column attached to and extending above said screen table;

b) an articulated first tong arm assembly pivotally attached to said vertical column;

c) an articulated second tong arm assembly pivotally attached to said vertical column above said first tong arm assembly; and d) an actuator means for applying rotational torque to said second tong arm assembly.

3. The gravel packer screen table and tong assembly according to claim 2 wherein said first and second tong arm assemblies each further comprise a tubular gripping head and an arm portion rotatably secured within an articulating means.

4. The gravel packer screen table and tong assembly according to claim 2 wherein said vertical column is threaded along its length and rotatably attached to said screen table.

5. The gravel packer screen table and tong assembly according to claim 4 wherein said first and second tong arm assemblies further comprise threaded members that allow cooperative engagement with said vertical column in a manner whereby each said tong assembly is traversely positional along the length of said vertical column by rotating said tong assemblies relative to said vertical column.

6. The gravel packer screen table and tong assembly according to claim 2 wherein said first and second tong arm assemblies are positional at 90-degree angles to one another.

7. The gravel packer screen table and tong assembly according to claim 1 wherein said screen table and tong assembly further comprise a slip set support collar having a slot therein for partially encircling a tubular section in a manner whereby said slip set support collar is supported by an enlarged portion of said tubular section.

8. The gravel packer screen table and tong assembly according to claim 1 wherein said tong assembly comprises:

a) a vertical column attached to and extending above said screen table;

b) an articulated first tong arm assembly pivotally attached to said vertical column; and c) a second tong arm assembly pivotally attached to said vertical column above said first tong arm assembly comprising a spinning means for rotating tubular members and an actuator means for applying rotational torque to said second tong assembly.

9. A gravel packer sand screen table and tong assembly for attachment to a drilling rotary table during the insertion and withdrawal of down hole packing tools and sand screen subsections into a well bore comprising:

a) a base structure attachable externally to and extending above said rotary table having a pair of capture doors slidable within a channel;

b) a set of manually articulated tong arms having tubular gripping tong heads, said set comprising a retaining tong and a torque head tong;

c) a means for pivotally attaching said set of manually articulated tong arms to said base structure; and d) an actuator means attached to one of said articulated tong arms for applying a rotating torque to said torque head tong.

10. The gravel packer screen table and tong assembly according to claim 9 wherein said screen table surrounds tubing extending into said well bore and is capable of capturing and suspending a tubing string within said well bore.

11. The gravel packer screen table and tong assembly according to claim 9 wherein said means for pivotally attaching said set of manually articulated tong arms to said base structure comprises a vertical column having means for traversing and pivotally positioning said tong arms independently and in combination relative to said base structure.

12. The gravel packer screen, table and tong assembly according to claim 11 wherein said means for traversing and pivotally positioning said tong arms is a threaded rod in cooperation with threaded members attached to said tong arms.

13. The gravel packer screen, table and tong assembly according to claim 11 wherein said means for traversing and pivotally positioning said tong arms is rotatably attached to said base structure.

14. The gravel packer screen table and tong assembly according to claim 9 wherein said tubular gripping tong heads are reversible between a first right hand gripping position and a second left hand gripping position.

15. The gravel packer screen table and tong assembly according to claim 9 wherein said screen table includes a means for supporting a slip set utilized to capture and suspend wash pipe within said sand screen sub-sections.

16. A method for coupling and uncoupling down hole sand screen subsections utilizing a combination screen suspension table and tong assembly comprising the steps of:

a) attaching said screen suspension table and tong assembly to a rotary table located on a well platform;

b) suspending a first tubular screen subsection within a well bore located below said rotary table and capturing said tubular screen subsection with said screen suspension table;

c) manipulating a retaining tong arm assembly to engage said first tubular screen subsection;

d) suspending and maneuvering a second tubular screen subsection into threaded engagement with said first tubular screen subsection, thereby producing a coupled joint;

e) manipulating a tong assembly having a torque actuator to engage said second tubular screen subsection at said coupled joint; and f) activating said torque actuator, thus applying rotation to said second tubular screen subsection until a preset torque is achieved.

17. The method according to claim 16 further comprising the step of installing a slotted support plate and collar around said coupled joint to support a slip set.

18. The method according to claim 17 further comprising the step of utilizing said slip set to support at least one pipe joint suspended within said screen subsection.

19. The method according to claim 16 further comprising the step of rotating a head portion of said tong assemblies between a first left-hand gripping position and a second right hand gripping position.

20. The method according to claim 16 further comprising the step of manipulating each said tong assembly in a manner whereby they oppose each other.

* * * * *